US007234731B2

(12) United States Patent
Naito et al.

(10) Patent No.: US 7,234,731 B2
(45) Date of Patent: Jun. 26, 2007

(54) GAS FEED PIPE CONNECTING SCREW FOR CONTINUOUS CASTING NOZZLE

(75) Inventors: Syojiro Naito, Ena-gun (JP); Kazuhide Uchida, Ena-gun (JP)

(73) Assignee: Akechi Ceramics Kabushiki Kaisha, Gifu (JP)

( * ) Notice: Subject to any disclaimer, the term of this patent is extended or adjusted under 35 U.S.C. 154(b) by 0 days.

(21) Appl. No.: 10/911,439

(22) Filed: Aug. 4, 2004

(65) Prior Publication Data

US 2005/0040651 A1 Feb. 24, 2005

(30) Foreign Application Priority Data

Aug. 5, 2003 (JP) ..... 2003-286348

(51) Int. Cl.
*F16L 3/04* (2006.01)
*F16L 41/00* (2006.01)

(52) U.S. Cl. ..... 285/141.1; 285/143.1; 285/212; 285/357; 285/915

(58) Field of Classification Search ..... 285/136.1, 285/141.1, 143.1, 212, 213, 215, 219, 291.1, 285/357, 915
See application file for complete search history.

(56) References Cited

U.S. PATENT DOCUMENTS

| | | | | | |
|---|---|---|---|---|---|
| 247,273 | A | * | 9/1881 | Ricketts | 285/206 |
| 424,690 | A | * | 4/1890 | Rossman | 220/304 |
| 911,225 | A | * | 2/1909 | Flach et al. | 222/400.7 |
| 1,245,088 | A | * | 10/1917 | Christensen | 137/324 |
| 1,304,414 | A | * | 5/1919 | Triplett | 285/212 |
| 1,463,692 | A | * | 7/1923 | Hail | 285/296.1 |
| 2,397,367 | A | * | 3/1946 | Francis | 285/215 |
| 2,452,262 | A | * | 10/1948 | Rosan | 285/92 |
| 2,780,092 | A | * | 2/1957 | Govan | 73/49.5 |
| 2,782,806 | A | * | 2/1957 | Stambaugh et al. | 138/109 |
| 2,926,935 | A | * | 3/1960 | La Marre | 285/184 |
| 3,112,127 | A | * | 11/1963 | Campbell | 285/143.1 |
| 3,462,539 | A | * | 8/1969 | Winston | 174/65 R |
| 3,756,628 | A | * | 9/1973 | St. Clair | 285/52 |
| 3,981,061 | A | * | 9/1976 | Jackson et al. | 29/890.11 |
| 4,694,513 | A | * | 9/1987 | Kiziah | 4/288 |
| 4,879,771 | A | * | 11/1989 | Piskula | 4/256.1 |
| 4,923,225 | A | * | 5/1990 | Luhrsen et al. | 285/189 |
| 5,085,536 | A | * | 2/1992 | Pelton | 403/343 |

(Continued)

FOREIGN PATENT DOCUMENTS

| | | |
|---|---|---|
| GB | 1 492 534 | 11/1977 |

(Continued)

*Primary Examiner*—James M. Hewitt
(74) *Attorney, Agent, or Firm*—Koda & Androlia

(57) ABSTRACT

A gas feed pipe connecting screw for a continuous casting nozzle which is mounted to the continuous casting nozzle formed with an axially extending ring-shaped slit concentric with a nozzle bore. The screw connects the nozzle to a gas feed pipe for blowing a gas into the slit. The screw includes a screw body having a gas feed hole formed through its central portion, a flange fitted into a mounting hole formed in a side wall of the continuous casting nozzle, a male thread engaging a first female thread formed in the mounting hole, and a second female thread formed in the gas feed hole for connection of the gas feed pipe. The flange has a detent corner engaging refractory mortar filling the mounting hole.

2 Claims, 3 Drawing Sheets

U.S. PATENT DOCUMENTS

| | | | | |
|---|---|---|---|---|
| 5,449,207 | A * | 9/1995 | Hockett | 285/286.2 |
| 2005/0077725 | A1* | 4/2005 | Bartholoma et al. | 285/143.1 |

FOREIGN PATENT DOCUMENTS

| | | |
|---|---|---|
| JP | 55-114449 | 9/1980 |
| JP | 2217145 | 8/1990 |
| JP | 2001-087845 | 4/2001 |
| JP | 2001-219252 | 8/2001 |
| JP | 2002-001498 | 1/2002 |

* cited by examiner

GAS FEED PIPE CONNECTING SCREW FOR CONTINUOUS CASTING NOZZLE

BACKGROUND OF THE INVENTION

1. Field of the Invention

This invention relates to a gas feed pipe connecting screw (hereinafter referred to as "connecting screw") mounted to a continuous casting nozzle (hereinafter referred to as "nozzle") formed with an axially extending ring-shaped slit substantially concentric with a nozzle bore for connecting to the nozzle a gas feed pipe blowing a gas into the slit.

2. Description of the Related Art

A nozzle used in continuous casting is formed with an axially extending ring-shaped slit substantially concentric with a nozzle bore in order that inclusion adherent to an inner wall of the nozzle during continuous casting may be eliminated. An inert gas such as argon gas is blown into the slit. A gas feed pipe feeding the inert gas is connected to a connecting screw mounted on a sidewall of the nozzle. JP-2001-219252-A discloses such a connecting screw. A female thread is formed so as to be continuous to a mounting hole of the nozzle side wall. A male thread adapted to be into mesh engagement with the female thread has three or more spot-welded portions w projecting from an outer circumference thereof. The mounting hole is filled with mortar y. The spot-welded portions are caused to engage the mortar y, whereby detent is provided as shown in FIG. 4.

However, each spot-welded portion has a lower detent strength than an integrally formed product. Moreover, a constant detent strength is difficult to obtain by achieving a uniform welding strength of each spot-welded portion, whereupon the detent strength differs from one product to another. As a result, the spot-welded portions would be broken due to high temperature, vibration or the like, so that the connecting screw would fall off from the nozzle. Additionally, a nut having a detent structure is proposed. However, the nut cannot be manufactured readily and the cost of the nut is increased since the nut has a complicated shape.

SUMMARY OF THE INVENTION

Therefore, an object of the present invention is to provide a connecting screw which can be manufactured readily and has a desirable detent effect.

To achieve the object, the present invention provides a gas feed pipe connecting screw for a continuous casting nozzle. The screw is mounted to the continuous casting nozzle formed with an axially extending ring-shaped slit substantially concentric with a nozzle bore. The screw connects to the nozzle a gas feed pipe blowing a gas into the slit. The screw comprises a screw body having a gas feed hole formed through substantially a central portion thereof, a flange fitted into a mounting hole formed in a side wall of the continuous casting nozzle, a male thread engaging a first female thread formed in the mounting hole, and a second female thread formed in the gas feed hole for connection of the gas feed pipe. The flange has a detent corner engaging mortar filling the mounting hole after having been fitted into the mounting hole.

In the above-described connecting screw, the flange adapted to be fitted into the mounting hole is formed with the detent corner which engages the mortar filling the mounting hole after the flange is fitted into the mounting hole, thereby providing detent. The connecting screw can be manufactured readily since the flange is formed integrally with the screw body by forging or the like. Furthermore, the connecting screw with high detent performance can be provided at low costs.

In a preferred form, the flange has a polygonal plane with apexes and the apexes serve as the detent corners. Consequently, the detent performance can further be improved since the engagement with the mortar is intensified.

In another preferred form, the detent corner is inscribed in the mounting hole. Consequently, the detent performance can further be improved by friction between the detent corners and the inner circumferential face of the mounting hole.

BRIEF DESCRIPTION OF THE DRAWINGS

Other objects, features and advantages of the present invention will become clear upon reviewing the following description of an embodiment with reference to the accompanying drawings, in which.

DETAILED DESCRIPTION OF THE INVENTION

Figure 1:
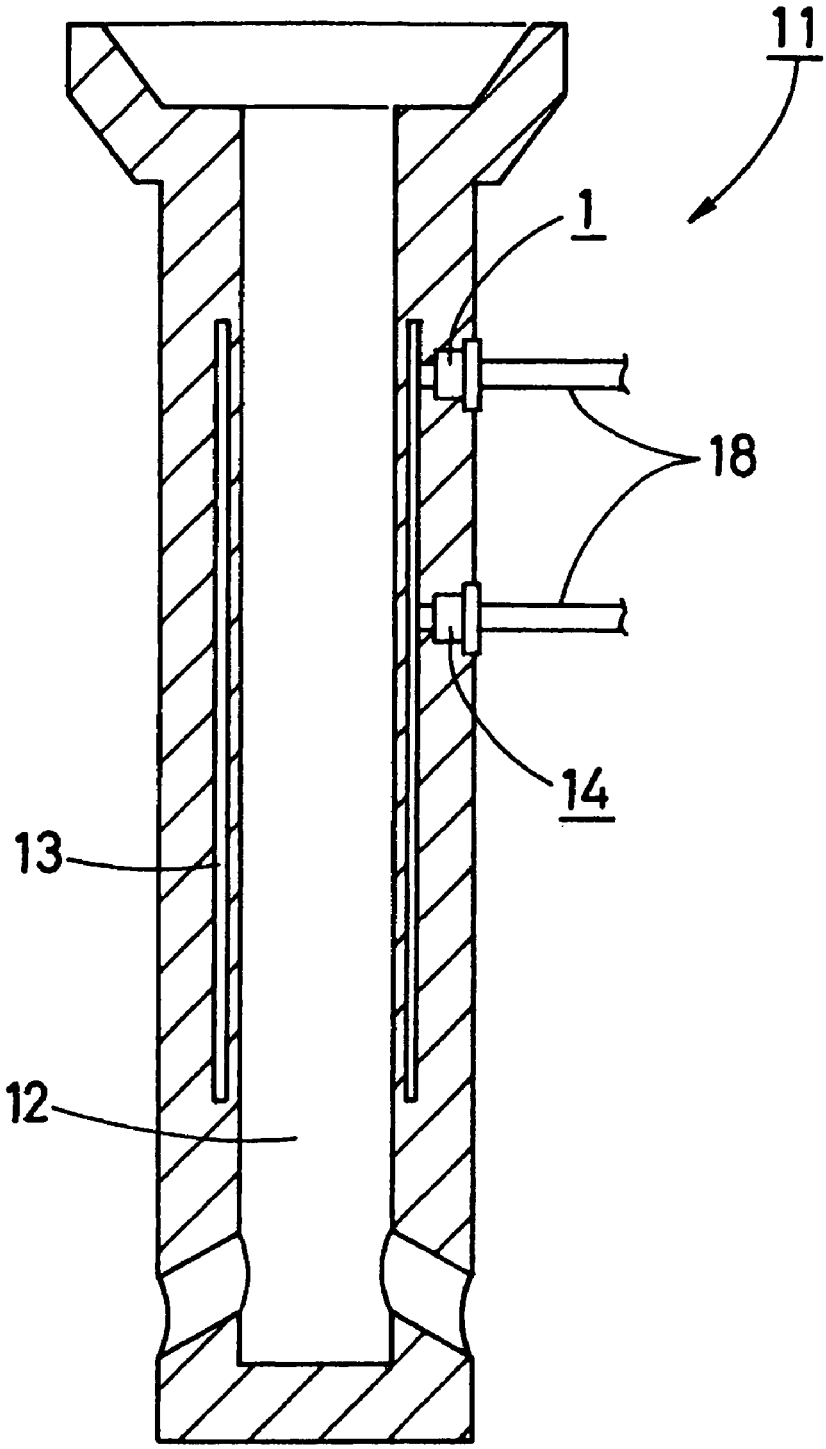
FIG. 1 is a schematic sectional view of the nozzle to which the connecting screw in accordance with one embodiment of the present invention is applied.
Figure 2:
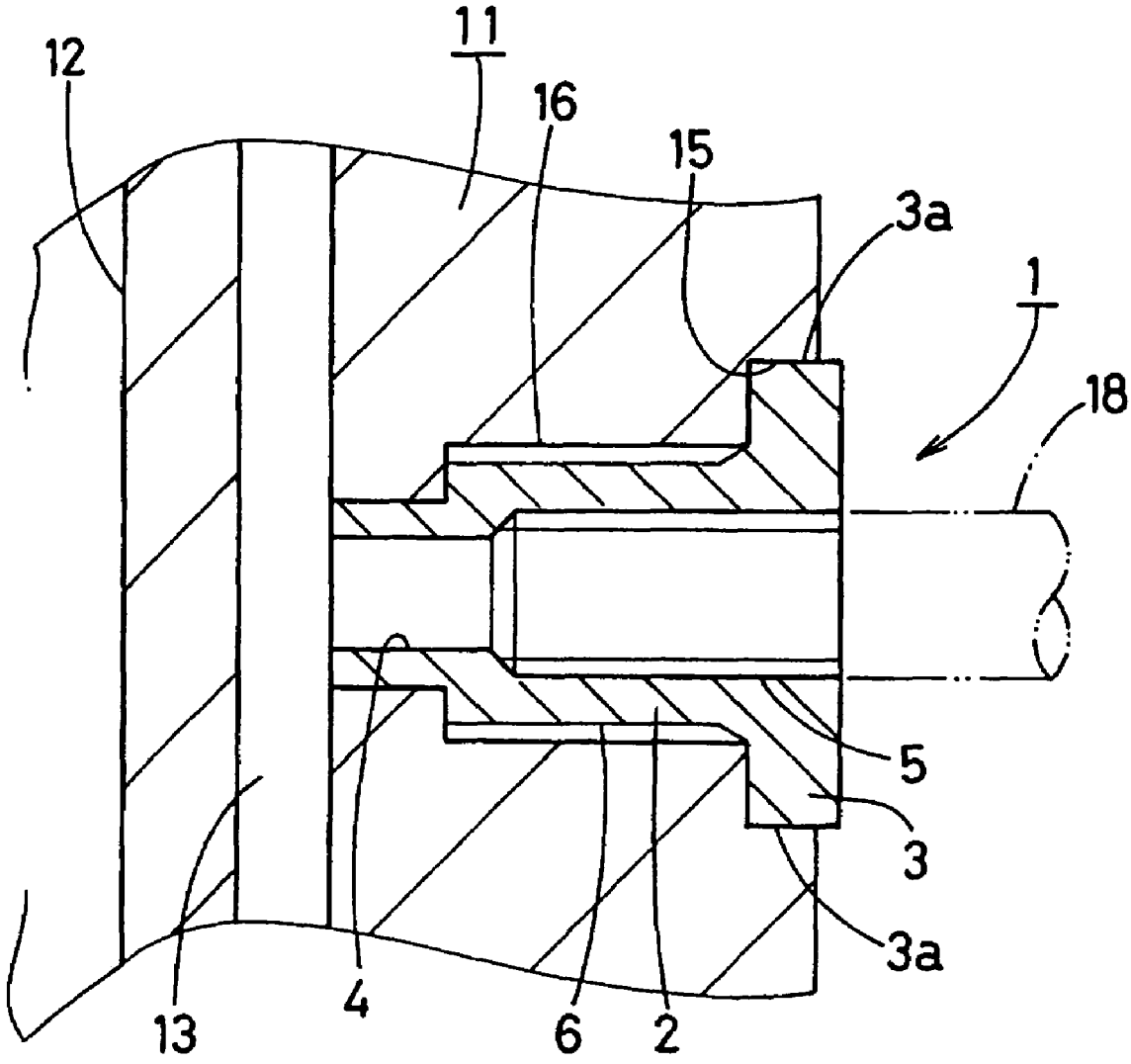
FIG. 2 is a partial sectional view of the nozzle to which the connecting screw is mounted.
Figure 3:
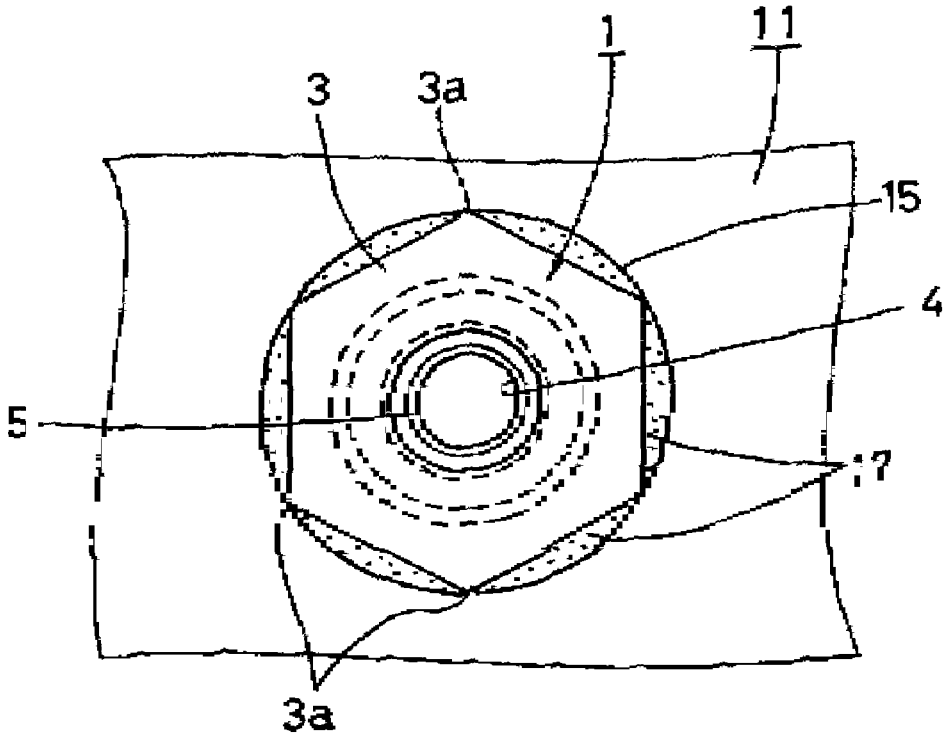
FIG. 3 is a front view of the nozzle to which the connecting screw is mounted.

One embodiment of the present invention will now be described with reference to FIGS. 1 to 3. Referring to FIG. 1, a nozzle 11 to which a connecting screw 1 of the embodiment is mounted is shown. The nozzle 11 has a nozzle bore 12 and an axially extending ring-shaped slit 13 substantially concentric with the nozzle bore 12. The nozzle 11 further has a mounting hole 14 formed in a side wall thereof. The mounting hole 14 communicates with the slit 13. The mounting hole 14 includes a fitting hole 15 into which a flange 3 of the connecting screw 1 is fitted and a female thread 16 formed so as to be continuous to the fitting hole 15. The connecting screw 1 includes a male thread 6 engaging the female thread 16.

A flange 3 having a hexagonal planar shape is formed integrally with a screw body 2 by forging or the like. The screw body 2 has a centrally located gas feed hole 4 formed therethrough. The gas feed hole 4 is formed with a female thread 5 for connecting a gas feed pipe. The screw body 2 further has a male thread 6 formed on an outer circumferential face thereof. The hexagonal flange 3 has six apexes serving as detent corners 3*a* respectively. The detent corners 3*a* are inscribed on the fitting hole 15 of the mounting hole 14 as shown in FIG. 3.

The connecting screw 1 is mounted to the mounting hole 14. Gaps are defined between the flange 3 and the inner circumferential face of the fitting hole 15. The gaps are filled with refractory mortar 17. A gas feed pipe 18 is connected to the female thread 5 so that an inert gas such as argon gas is fed to the slit 13 of the nozzle 11 during the continuous casting.

Figure 4:
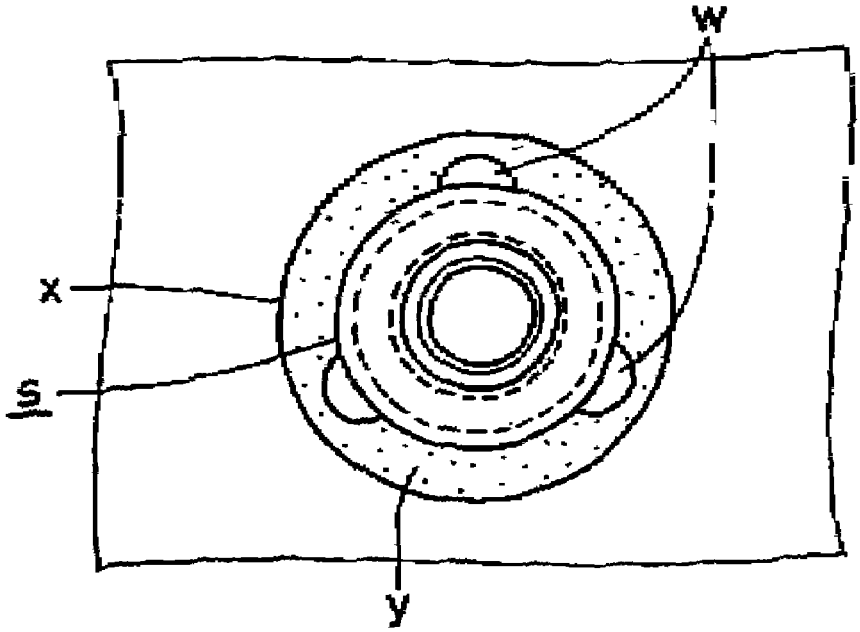
FIG. 4 PRIOR ART
FIG. 4 is a front view of a nozzle to which a conventional connecting screw is mounted.

TABLE 1 shows comparison between the strength (torque value (kg/cm$^2$) of the connecting screw 1 thus constructed and the strength of a conventional connecting screw s as shown in FIG. 4. In the conventional connecting screw s, an average strength is 500 kg/cm$^2$ at room temperature and 327 kg/cm$^2$ at 1,000° C. On the other hand, the above-described connecting screw 1 has an average strength of 1,220 kg/cm$^2$ at a room temperature and 737 kg/cm$^2$ at 1,000° C. The values in the connecting screw 1 are twice as large as those in the conventional connecting screw s or more.

TABLE 1

| Strength (torque in kg/cm$^2$) | Connecting screw 1 | Connecting screw s |
|---|---|---|
| Room temperature | 1,220 | 500 |
| 1,000° C. | 737 | 327 |

Furthermore, differences in the strength are larger in the conventional connecting screw s than in the connecting screw 1 as shown in TABLE 2.

TABLE 2

| DIFFERENCES IN STRENGTH (TORQYE IN kg/cm$^2$) | | |
|---|---|---|
| | Connecting screw 1 | Connecting screw s |
| Room temperature | 1,140, 1,260, 1,260 | 530, 440, 550 |
| 1,000° C. | 730, 740, 740 | 380, 260, 340 |

As described above, the connecting screw 1 of the embodiment includes the flange 3 fitted into the fitting hole 15 of the mounting hole 14. The flange 3 has the hexagonal planar shape. The flange 3 engages the refractory mortar 17 filling the fitting hole 15 after the flange 3 has been fitted into the fitting hole 15, thereby providing detent. Since the flange 3 is formed integrally with the screw body 2 by the forging or the like, the connecting screw 1 can be manufactured readily. Furthermore, the connecting screw 1 with high detent performance can be provided at low costs. The plane of the flange 3 should not be limited to the hexagonal shape. The plane of the flange 3 may be triangular, square or otherwise polygonal in shape, instead. Each apex of the polygonal flange 3 serves as the detent corner 3*a*. Additionally, since the detent corners 3*a* are inscribed on the fitting hole 15 of the mounting hole 14, the detent performance can further be improved by friction between detent corners 3*a* and the inner circumferential face of the fitting hole 15.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A connecting assembly for a gas feed pipe, the connecting assembly comprising:

a continuous casting nozzle;

a screw body having a gas feed hole formed through substantially a central portion thereof;

a flange fitted into a mounting hole formed in a side wall of the continuous casting nozzle;

a male thread engaging a first female thread formed in the mounting hole; and a second female thread formed in the gas feed hole for connection of the gas feed pipe, wherein the flange has at least one detent corner engaging mortar filling the mounting hole after having been fitted into the mounting hole; and the at least one detent corner is inscribed in the mounting hole.

2. A connecting assembly for a gas feed pipe, the connecting assembly comprising:

a continuous casting nozzle;

a screw body having a gas feed hole formed through substantially a central portion thereof;

a flange fitted into a mounting hole formed in a side wall of the continuous casting nozzle;

a male thread engaging a first female thread formed in the mounting hole; and a second female thread formed in the gas feed hole for connection of the gas feed pipe, wherein the flange has at least one detent corner engaging mortar filling the mounting hole after having been fitted into the mounting hole;

the flange has a polygonal planar shape with apexes and the apexes serve as the detent corners; and the at least one detent corner is inscribed in the mounting hole.

* * * * *